US006474487B1

(12) United States Patent
Kretschmer

(10) Patent No.: US 6,474,487 B1
(45) Date of Patent: Nov. 5, 2002

(54) RING LIFTING CRANE

(75) Inventor: Manfred Kretschmer, Hilden (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/647,116

(22) PCT Filed: Mar. 22, 1999

(86) PCT No.: PCT/DE99/00940

§ 371 (c)(1),
(2), (4) Date: Sep. 26, 2000

(87) PCT Pub. No.: WO99/48796

PCT Pub. Date: Sep. 30, 1999

(30) Foreign Application Priority Data

Mar. 26, 1998 (DE) ..... 198 14 636

(51) Int. Cl.[7] ..... B66C 23/36
(52) U.S. Cl. ..... 212/298; 212/299; 212/301
(58) Field of Search ..... 212/301, 299, 212/300, 347, 298

(56) References Cited

U.S. PATENT DOCUMENTS 4,336,889 A * 6/1982 Mcgrew ..... 212/178
4,483,448 A * 11/1984 Wittman et al. ..... 212/189
4,579,234 A * 4/1986 Delago et al. ..... 212/178
4,601,402 A * 7/1986 Helm et al. ..... 212/189
4,729,486 A * 3/1988 Petzold et al. ..... 212/189

FOREIGN PATENT DOCUMENTS

DE 3838975 * 5/1990

* cited by examiner

*Primary Examiner*—Thomas J. Brahan
(74) *Attorney, Agent, or Firm*—Cohen, Pontani, Lieberman & Pavane

(57) ABSTRACT

A ringlift crane having a ring which can be elevated and forms an annular track. Arranged within the ring is a standardized undercarriage from a first crane class and a standardized upper carriage, which is connected for stewing action to the undercarriage and has a plurality of hoisting winches. The upper carriage is connected to one adapter in both end regions. The adapters are supported with rolling action on the annular track of the ring by rollers. The center point of the ring and/or of the undercarriage forms the stewing axis. One adapter is designed for accommodating a counterweight and the other adapter is designed as a load-bearing element for the main boom and the mast (counter-boom) which can be articulated at the free end of the adapter. The top of the mast is connected, on the one hand, to the counterweight via a stay cable and, on the other hand, to the head of the main boom via a changeable-length cable stay. A stay support is articulated on that side of the mast which is inclined toward the counterweight. The free end of the stay support is connected to the free end of the load-bearing bars of the counterweight via a changeable-length cable stay. The free cable end of the cable stay is connected to an auxiliary hoisting winch arranged on the load-bearing element.

5 Claims, 6 Drawing Sheets

RING LIFTING CRANE

PRIORITY CLAIM

This is a national stage of application No. PCT/DE99/00940, filed on Mar. 22, 1999. Priority is claimed on that application and on the following application:

Country: Germany, Application No: 198 14 636.1, Filed Mar. 26, 1998.

FIELD OF THE INVENTION

The invention relates to a ringlift crane.

A ringlift crane of the generic design is known from the Mannesmann Demag Baumaschinen company brochure entitled "Ringlift Cranes" CC 2000 RL; CC 4000 RL, issue 11/82. This known ringlift crane has a ring which can be elevated, forms an annular track and comprises a plurality of segments which can be connected to one another. Arranged within the ring is an undercarriage and an upper carriage, which is connected for slewing action to the undercarriage and has a plurality of hoisting winches. In the two end regions, the upper carriage is connected to in each case one adapter, and these adapters are supported with rolling action on the annular track of the ring by means of sets of rollers which are arranged on the adapters and are connected to one another via links. In this case, the center point of the ring and/or of the undercarriage forms the slewing axis. One adapter is designed for accommodating a counterweight and the other adapter is designed as a load-bearing element for a boom (main boom+mast) which can be articulated at the free end of the adapter. The slewing movement of the ringlift crane is produced by means of a toothed rim, which is arranged on the inside of the ring, and pinions which engage in said rim and are mounted via links. For the purpose of stabilizing the overall structure, the undercarriage is connected to different sections of the ring via reinforcing struts. The tip of the mast is connected, on the one hand, to the counterweight via a stay cable and, on the other hand, to the head of the main boom via a changeable-length cable stay.

A comparable design is known from U.S. Pat. No. 4,103,783. This ringlift crane comprises a ring, which can be elevated and forms an annular track, and a structure within the ring with a kingpin and a platform which is provided with a sleeve for accommodating the kingpin. In the two end regions, the platform is connected to in each case one adapter, these adapters being supported with rolling action on the ring by means of sets of rollers arranged on the adapters, the center point of the ring forming the slewing axis for the platform. A plurality of hoisting winches are arranged on the platform and a counterweight is arranged on the rear adapter. A main boom and a mast (counter-boom) are articulated on the front adapter. The single-part ring is stiffened by struts which run within the ring in secant form.

According to the prior art, ringlift cranes of the type explained above acquire a high-outlay assembly and dismantling procedure in order to be erected or laid down, respectively.

SUMMARY OF THE INVENTION

The object of the invention is to provide a ringlift crane which can easily be erected and laid down.

According to the invention, a stay support is arranged on that side of the mast which is directed toward the counterweight. The free end of the stay support is connected to the free end of the load-bearing bars of the counterweight via a changeable-length cable stay. The free end of the cable stay is connected, in turn, to an auxiliary hoisting winch arranged on the load-bearing element. This arrangement makes it possible for the mast and the main boom to be erected and laid down easily. In order that there is no adverse effect to the normal hoisting-winch operation, in particular for the hoist cable, it is preferable for both the stay support and the auxiliary hoisting winch to be arranged on one side, outside the operating region of the main hoisting winches.

The stay support and auxiliary hoisting winch are connected via a cable drive with sets of rollers arranged correspondingly at the free end of the stay support and on the load-bearing bars. The length and the point of articulation on the mast of the stay support is selected such that, once the mast has been erected, the head region of the stay support can be laid down on the counterweight. This has the advantage that the hoisting-winch operation also remains freely accessible from the side of the stay support.

BRIEF DESCRIPTION OF THE DRAWING

The operation according to the invention of erecting a mobile ringlift crane is explained in the drawing with reference to the illustration of the sequence of different positions. In the drawing.

DETAILED DESCRIPTION OF THE PREFERRED EMBODIMENTS

Figure 1:
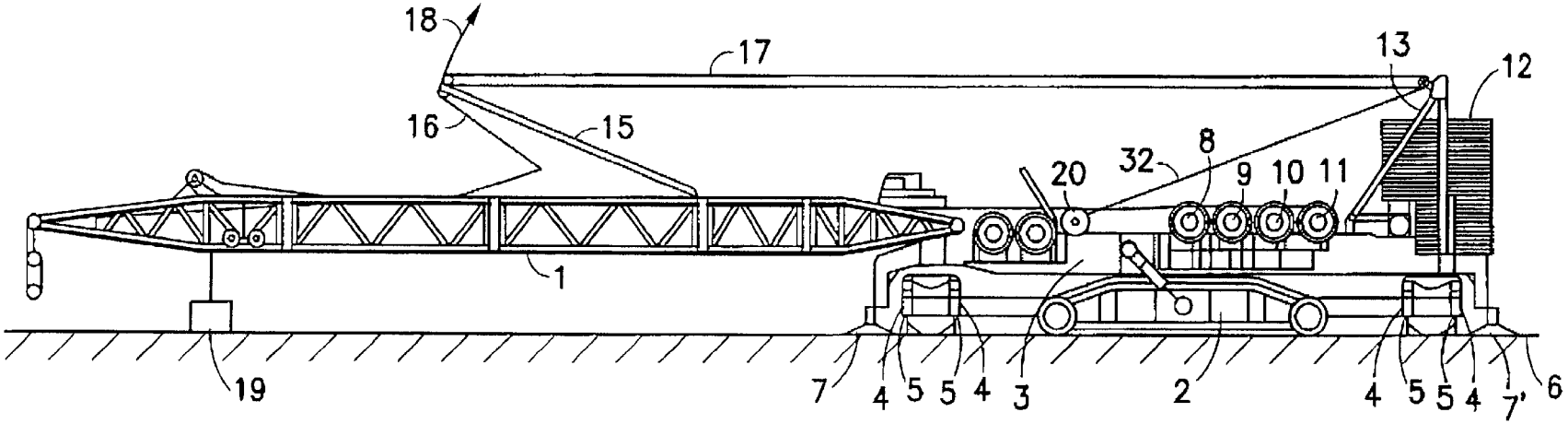
FIG. 1 shows the starting position with the mast arranged on the load-bearing element.

FIG. 1 shows a basic schematic illustration, in a first position, of the arrangement of a mast 1 before being erected. The mobile ringlift crane illustrated here comprises an undercarriage, in this case a crawler undercarriage 2, and a load-bearing element 3 which is arranged thereabove, projects toward both sides and is designed as the truss. In the two end regions, the load-bearing element 3 is supported with rolling action on a ring which encloses the crawler undercarriage 2. In this exemplary embodiment, the ring is designed as a double ring 4. The double ring 4 is supported on the ground 6 in an elevated state by means of a plurality of supports 5. In order for it to be possible for the erected ringlift crane to be made to travel as a whole by means of the crawler undercarriage 2, a piston/cylinder unit 7, 7' is arranged at each of the ends of the load-bearing element 3. The piston/cylinder units 7, 7' are designed such that they can raise the ringlift crane as an entire unit in order to lock the load-bearing element 3 to the crawler undercarriage 2. The main hoisting winches 8–11 are arranged in the central region of the load-bearing element 3. In the right-hand end region here, a counterweight 12 is arranged on the load-bearing element 3 and is supported laterally by load-bearing bars 13, 14. The mast 1 is articulated at that end of the load-bearing element 3 which is on the left FIG. 1. According to the invention, for the purposes of erecting and laying down the mast 1, a stay support 15 is articulated on the side which is directed toward the counterweight 12. The free end of the stay support 15 is connected, on the one hand, to a stay cable 16 and, on the other hand, to a changeable-length cable stay 17. The other end of the cable stay 17 is connected to the head region of the load-bearing bars 13, 14 of the counterweight 12. From there, the free end of the cable 32 runs to an auxiliary hoisting winch 20 arranged on the load-bearing element 3. The direction in which the stay support 15 is set upright is indicated by an arrow 18. In order for it to be possible for the mast 1 to be arranged at the same level as the load-bearing element 3, a rest 19 assists by propping up the head region.

Figure 2:
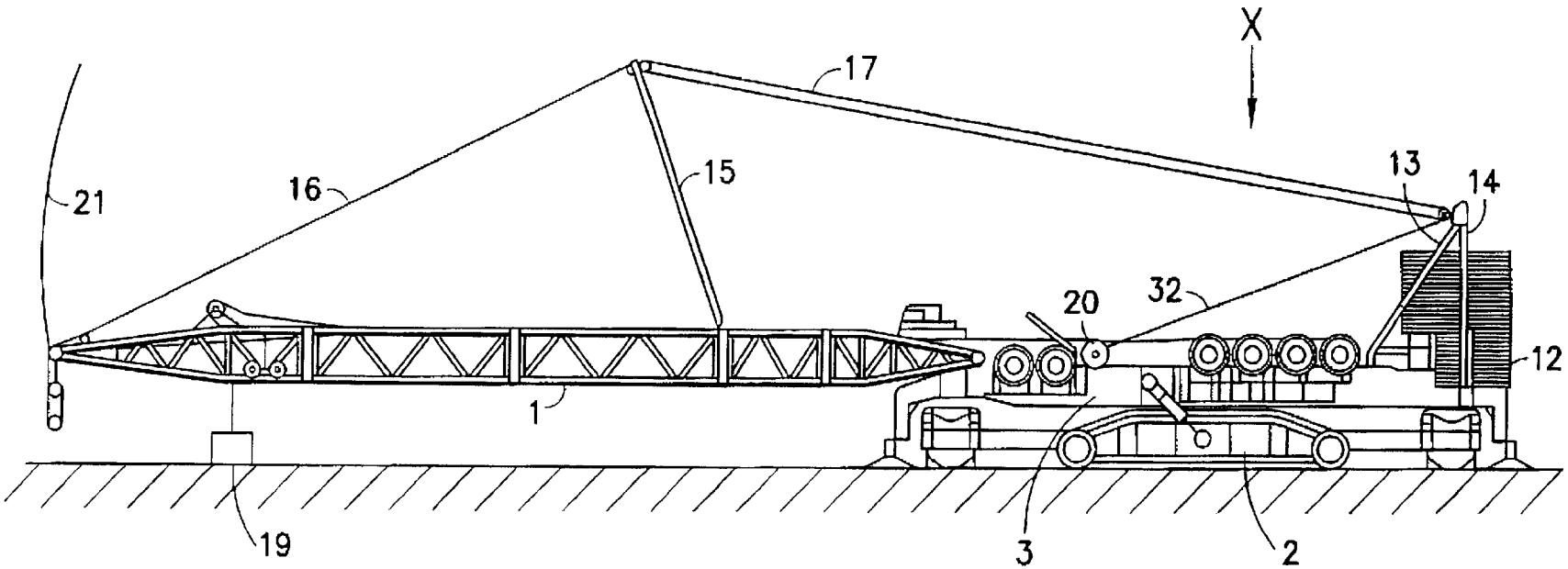
FIG. 2 shows the position immediately before the mast is erected.

FIG. 2 shows a further position, in which, once the stay support 15 and the tensioned stay cable 16 have been set upright, the mast 1 is just about to be erected. The direction in which the mast 1 is set upright is indicated by an arrow 21.

Figure 3:
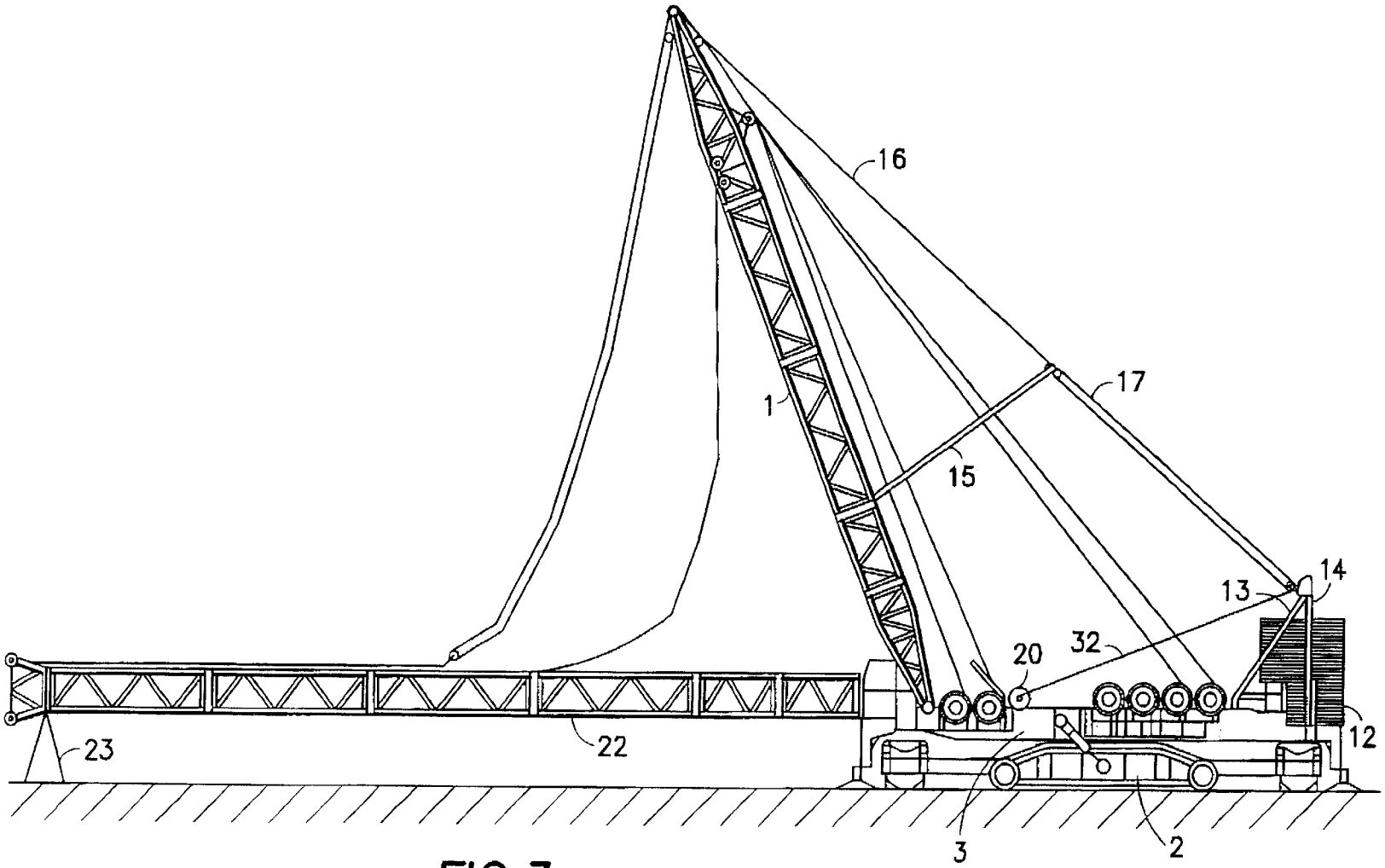
FIG. 3 shows the position in which the mast is partially erected and the main boom is arranged on the load-bearing element.

FIG. 3 illustrates, in a further position, the partial erection of the mast 1 and the articulation of the main boom 22. In order to bring the main boom 22 and load-bearing element 3 level with one another, a stand 23 props up the head region of the main boom 22.

Figure 4:
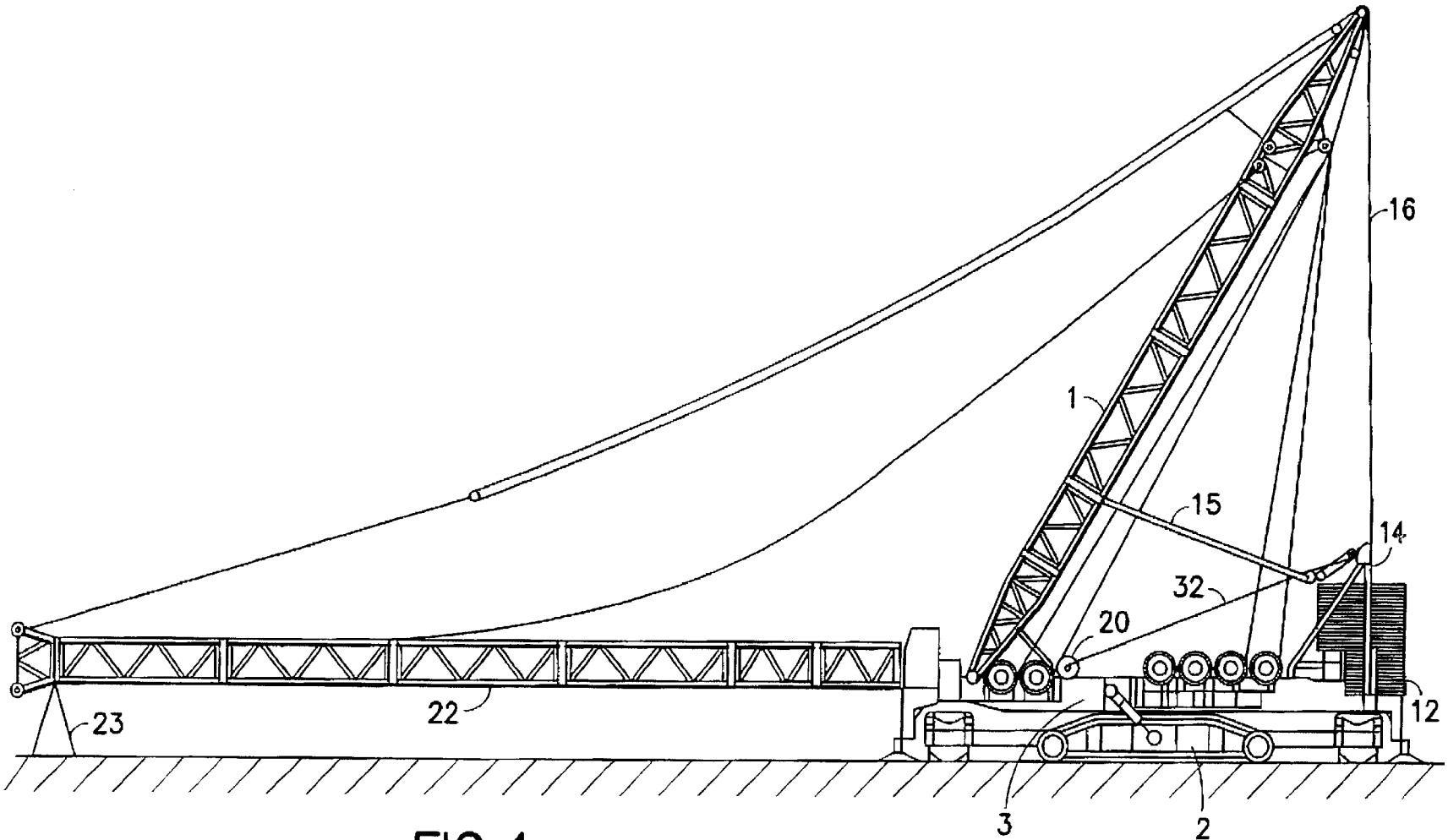
FIG. 4 shows the position with the mast erected, before the main boom is erected.

FIG. 4 shows, in a final position, the end position of the mast 1 just before the main boom 22 is erected. The details of this concluding phase are illustrated as detail A in FIGS. 5 and 6.

For the purpose of fastening the stay cable 16, the end region of the stay support 15 has a web plate 25 provided with a connection eyelet 24. In the same way, the head region the load-bearing bars 13, 14 is also provided with two web plates 27, 29 provided with in each case one connection eyelet 26, 28. Arranged on the web plate 29, which is directed toward the stay support 15, is a set of pulleys 30 which interacts with a set of pulleys 31 which is arranged with pendulum action on the stay support 15 by means of a link plate 33. Arranged between the two sets of pulleys 30, 31 is the above-mentioned cable stay 17, of which the free cable end 32 is guided to the auxiliary hoisting winch 20. A bearing plate 35 is arranged at the end of the stay support 15, beneath the set of pulleys 31.

Figure 5:
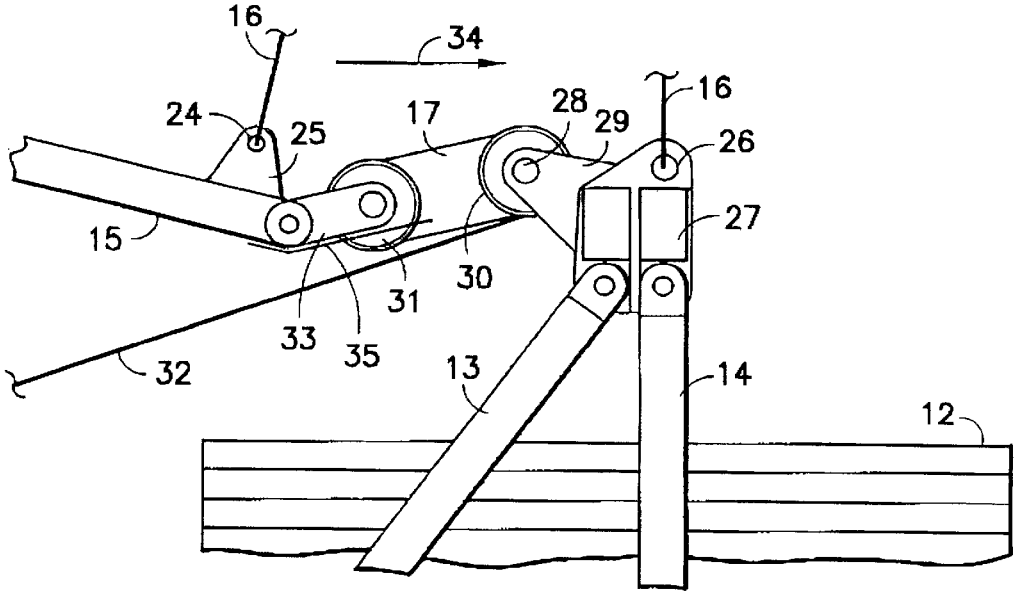
FIG. 5 shows an illustration in detail form of the transfer of the stay cable.

FIG. 5, then, shows a position in which, by virtue of the cable stay 17 being tightened to the shortest distance, the stay cable 16 is relieved of loading, with the result that it can be transferred from the end of the stay support 15 to the load-bearing bars 13, 14 in accordance with the arrow 34.

Figure 6:
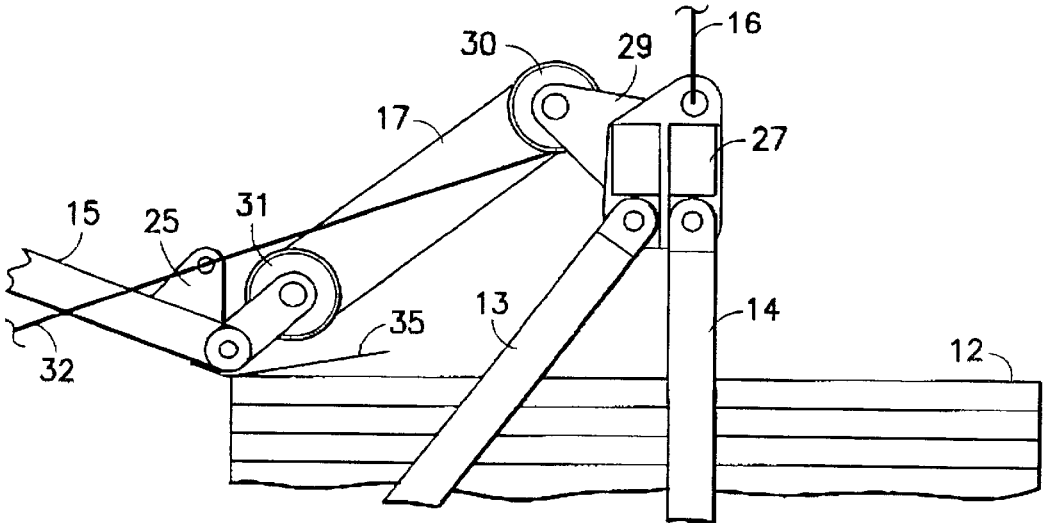
FIG. 6 shows an illustration in detail form of the stay support laid down.

Following this operation, it is possible, according to FIG. 6, for the cable stay 17 to be laid down on the top edge of the counterweight 12 by means of the bearing plate 35. The stay support 15 is thus relieved of loading and the mast 1 is fixed via the stay cable 16, which is then connected fixedly to the load-bearing bars 13, 14 of the counterweight 12.

Figure 7:
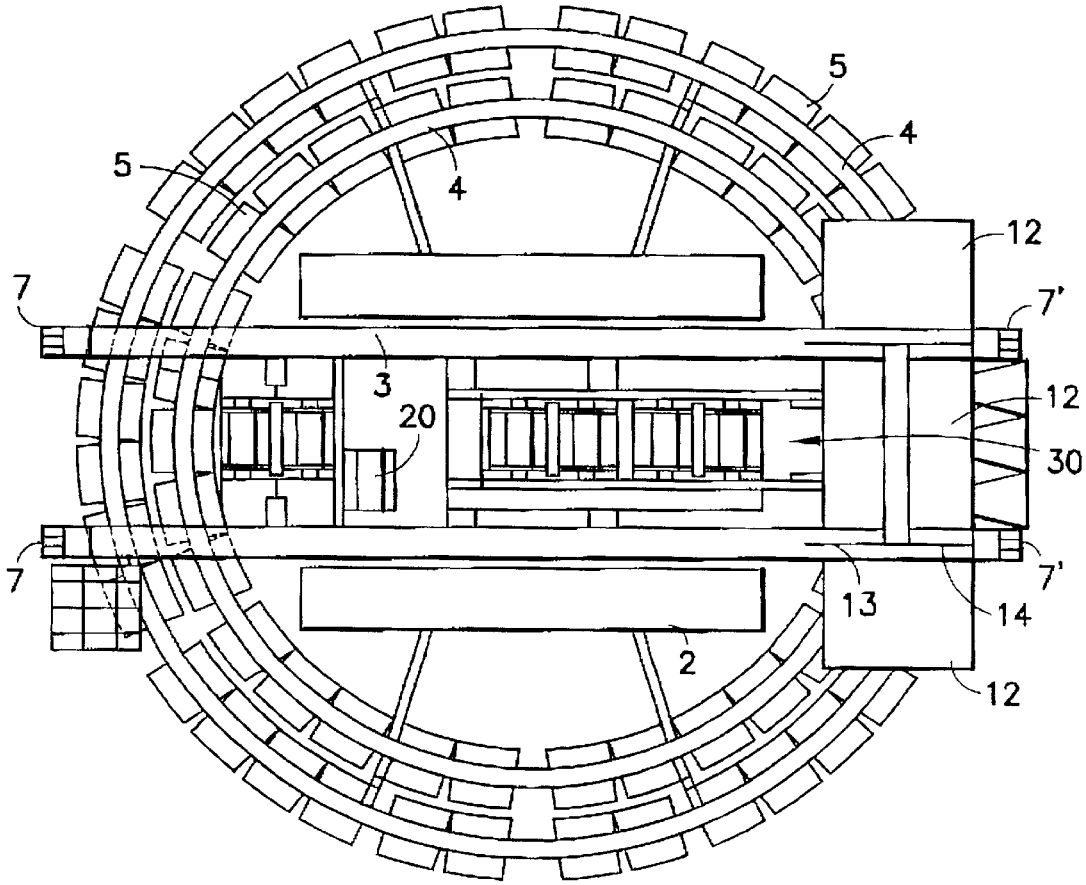
FIG. 7 shows the view in direction X in FIG. 2.

FIG. 7 shows a view in the direction X in FIG. 2. In this view, it is possible to see the auxiliary hoisting winch 20 and the set of pulleys 30 arranged on one side, outside the region of the main hoisting winches 8–11.

What is claimed is:

1. A ringlift crane, comprising:

a ring which forms an annular track;

an undercarriage and an upper carriage arranged within said ring which is connected for slewing action to the undercarriage and has a plurality of hoisting winches;

a load-bearing element;

rollers arranged to support the load-bearing element with rolling action on the annular track of the ring, a center point of at least one of the ring and the undercarriage forming a slewing axis;

a counterweight having load bearing bars and arranged at one end of the load-bearing element;

a main boom;

a mast, the main boom and the mast being articulated to another end of the load-bearing element;

a stay cable arranged to connect a top of the mast to the counterweight in an operating condition of the crane;

a changeable-length cable stay arranged to connect a head of the main boom to the top of the mast;

a stay support articulated on the mast on a side of the mast which is inclined toward the counterweight, a free end of the stay support being connectable to the stay cable of the mast for lifting the top of the mast into an operating position;

a further changeable-length cable stay arranged to connect a free end of the stay support to a free end of the load-bearing bars of the counterweight; and an auxiliary hoisting winch arranged on the load-bearing element, a free cable end of the further changeable-length cable stay being connected to the auxiliary hoisting winch, whereby the top of the mast, when connected to the head of the main boom by the changeable-length cable stay, is liftable into a relaxed position by reducing the length of the further changeable-length cable stay so that tension in the stay cable is released in the relaxed position whereby one end of the stay cable is disconnectable from the stay support and connectable to the counterweight in the relaxed position.

2. A ringlift crane as defined in claim 1, wherein both the stay support and the auxiliary hoisting winch are arranged on a common side of the upper carriage, outside an operating region of the hoisting winches.

3. A ringlift crane as defined in claim 1, and further comprising a web plate having a connection eyelet arranged at the free end of the stay support and a set of pulleys articulated to the free end of the stay support by a link plate.

4. A ringlift crane as defined in claim 1, and further comprising two web plates, provided with in each case one connection eyelet, arranged at the free end of the load-bearing bars of the counterweight.

5. A ringlift crane as defined in claim 1, wherein a point of articulation on the mast and a length of the stay support are selected so that, in an erected state of the mast, a head region of the stay support can be laid down on the counterweight.

* * * * *